US006927736B1

(12) United States Patent
Kornbau et al.

(10) Patent No.: US 6,927,736 B1
(45) Date of Patent: Aug. 9, 2005

(54) SYSTEM AND METHOD FOR INTEGRATING ANTENNAS INTO A VEHICLE REAR-DECK SPOILER

(75) Inventors: Thomas W. Kornbau, Bellbrook, OH (US); Hirsch M. Chizever, Rockwall, TX (US); Ivan W. Soper, Xenia, OH (US)

(73) Assignee: Mission Research Corporation, Dayton, OH (US)

( * ) Notice: Subject to any disclaimer, the term of this patent is extended or adjusted under 35 U.S.C. 154(b) by 6 days.

(21) Appl. No.: 10/440,449

(22) Filed: May 16, 2003

Related U.S. Application Data

(60) Provisional application No. 60/381,740, filed on May 17, 2002.

(51) Int. Cl.[7] ..... H01Q 1/32
(52) U.S. Cl. ..... 343/712; 343/711
(58) Field of Search ..... 343/711, 712, 715, 343/742, 867; 455/345, 282

(56) References Cited

U.S. PATENT DOCUMENTS

| | | | | |
|---|---|---|---|---|
| 4,760,402 | A * | 7/1988 | Mizuno et al. | 343/713 |
| 5,097,270 | A | 3/1992 | Lindenmeier et al. | 343/704 |
| 5,106,141 | A | 4/1992 | Mostashari | 296/24.1 |
| 5,177,493 | A | 1/1993 | Kawamura | 343/713 |
| 5,266,960 | A | 11/1993 | Lindenmeier et al. | 343/704 |
| 5,621,422 | A * | 4/1997 | Wang | 343/895 |
| 5,629,712 | A | 5/1997 | Adrian et al. | 343/713 |
| 5,801,663 | A | 9/1998 | Lindenmeier et al. | 343/713 |
| 5,812,095 | A | 9/1998 | Adrian et al. | 343/713 |
| 5,918,183 | A * | 6/1999 | Janky et al. | 455/456.1 |
| 5,945,956 | A | 8/1999 | Izawa et al. | |
| 5,949,381 | A * | 9/1999 | Saitoh et al. | 343/713 |
| 5,977,919 | A | 11/1999 | Kudo et al. | 343/713 |
| 6,031,499 | A | 2/2000 | Dichter | 343/713 |
| 6,057,803 | A | 5/2000 | Kane et al. | 343/713 |
| 6,144,296 | A | 11/2000 | Ishida et al. | 340/461 |
| 6,683,570 | B2 * | 1/2004 | Skladany et al. | 343/700 MS |
| 6,692,051 | B1 * | 2/2004 | Cook et al. | 296/24.39 |

* cited by examiner

*Primary Examiner*—Tuyet Vo
*Assistant Examiner*—Minh Dieu A
(74) *Attorney, Agent, or Firm*—Knobbe Martens Olson & Bear LLP

(57) ABSTRACT

An automotive spoiler-type device to house a suite of sensors is described. Such sensors can include, for example, transmit antennas, receive antennas, video cameras, Infrared (IR) sensors, Electro-Optic (EO) sensors, air sensors, etc. Examples of the information transmitted and received include voice, data, navigation, and other communications functions, including, but not limited to, two-way radios, GPS, wireless Internet applications, etc. In one embodiment, the spoiler antenna installations are lower in profile and more compact than conventional vehicle antennas. In one embodiment, a top-load portion of a monopole antenna is used as a ground plane for a patch-type or cavity type antenna.

21 Claims, 10 Drawing Sheets

SYSTEM AND METHOD FOR INTEGRATING ANTENNAS INTO A VEHICLE REAR-DECK SPOILER

REFERENCE TO RELATED APPLICATION

The present application claims priority benefit of U.S. Provisional Application No. 60/381,740, filed May 17, 2002, titled SYSTEM AND METHOD FOR INTEGRATING ANTENNAS INTO A VEHICLE REAR-DECK SPOILER, the entire contents of which is hereby incorporated by reference.

BACKGROUND

1. Field of the Invention

The present invention relates to antennas installed on an automobile or other vehicle.

2. Description of the Related Art

For many years the only antenna found on an automobile or other vehicle was likely to be a monopole whip antenna for an AM/FM radio. Today, a vehicle such an automobile, boat, an the like, is likely to have several antennas for various devices, such as, for example, an AM/FM radio, a cellular telephone, a satellite radio, a GPS receiver, etc. Police, emergency vehicles, and aircraft, have even more antennas for various radio communication and/or data systems. In addition to antennas, other sensors such as electro-optic sensors, cameras, etc. are also becoming more common on vehicles. These antennas and other sensors are often considered to be unsightly. Moreover, sensors that are not integrated into the vehicle are more likely to be damaged by accidents or vandalism, and can reduce gas mileage by creating aerodynamic drag.

SUMMARY OF THE INVENTION

The present invention solves these and other problems by providing sensors that are integrated into structures typically found on a vehicle such as an automobile, boat, airplane, etc. In one embodiment, sensors such as antennas are integrated into an automotive spoiler-type device to support the transmission and reception of information. Such sensors can include, for example, transmit antennas, receive antennas, video cameras, Infrared (IR) sensors, Electro-Optic (EO) sensors, air sensors, etc. Examples of the information transmitted and received include voice, data, navigation, and other communications functions, including, but not limited to, two-way radios, GPS, wireless Internet applications, etc. In one embodiment, the spoiler antenna installations are lower in profile and more compact than conventional vehicle antennas.

The inclusion of sensors in a spoiler, which is installed as a unit, has the additional benefits of concealment (the presence of equipment in the vehicle is not revealed by visible sensors and/or antennas), protection of the sensors from damage, (e.g., car wash damage, vandalism, etc.) robustness, and reduced life-cycle costs.

In one embodiment, four antennas and a brake light (the so-called third brake light) are provided in a spoiler. In one embodiment, three antennas cover three transmit/receive frequency bands, namely 150–160 MHz, 423–469 MHz, and 806–869 MHz. The fourth antenna covers the GPS receive bands. These frequency bands represent so-called instantaneous bandwidths of the antennas (where tuning is not needed to achieve a desired transmit/receive performance over the stated bands). These particular transmit/receive frequency bands are currently being used by police, fire and various business radio services. In particular, the 150–160 MHz band demonstrates a relatively long-wavelength case (~>6 feet). In one embodiment, one or more of the spoiler antennas handle Continuous Wave (CW) transmit power levels of up to approximately 100 Watts.

In one embodiment, the spoiler antennas are configured as monopole and top-loaded monopole antennas. In one embodiment, other antennas, such as, for example, GPS antennas, satellite radio antennas, etc. are integrated into the spoiler.

BRIEF DESCRIPTION OF THE DRAWINGS

The advantages and features of the disclosed invention will readily be appreciated by persons skilled in the art from the following detailed description when read in conjunction with the drawings listed below.

DETAILED DESCRIPTION

Figure 1:
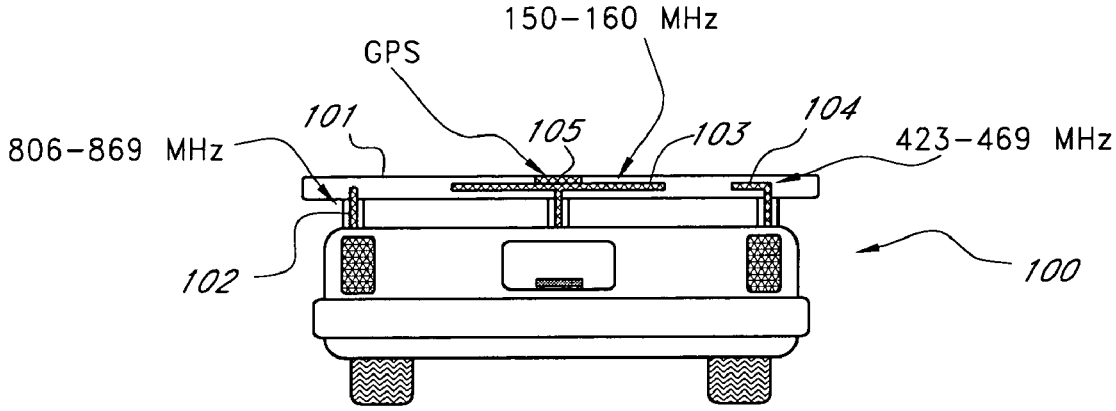
FIG. 1 shows a suite of antennas integrated into an automobile spoiler-type structure to provide relatively moderate bandwidth coverage.

FIG. 1 shows one embodiment of a system 100 having an antenna suite integrated into a spoiler-type structure on an automobile or other vehicle. The system 100 includes a spoiler 101, a low-band antenna 102, a medium-band antenna 104, and a high-band antenna 102. In one embodiment, the antennas 102–104 are monopole-type antennas. In one embodiment, the low-band antenna 102 and the medium-band antenna 104 are top-loaded monopoles. In one embodiment, the low-band antenna 103 operates in a band from 150–160 MHz. In one embodiment, the medium-band antenna 104 operates in a band from 423–469 MHz. In one embodiment, the high-band antenna 103 operates in a band from 806– 869 MHz. In one embodiment, the low-band antenna 103 is located between the medium-band antenna 104 and the high-band antenna 102. In FIG. 1, the spoiler 101 includes three risers (left, center, and right) that connect the spoiler 101 to the vehicle. The vertical portion of the monopole-type antennas used for the antennas 102–104 are located in the three risers.

A horizontal-type antenna 105 is also integrated into the spoiler 101. The horizontal-type antenna 105 can be an annular ring antenna, patch antenna, microstrip antenna, stripline antenna etc. In one embodiment, the horizontal-type antenna 105 is used for receiving satellite signals for systems such as, for example, XM radio, Global Positioning System (GPS) navigation, etc.

Spoiler-type structures such as the structure 101 are commonly used on automobiles to improve aesthetics and/or aerodynamic performance of the vehicle. Such spoiler-type structures are also found on boats, aircraft, etc. In one embodiment, the spoiler 101 also incorporates a brake light 110. The brake light 110 is usually a "third brake light" that is provided in addition to the typical left and right brake lights found on vehicles. In one embodiment, the type of light used for the brake light 110, and the power connections to the third brake light 110 (e.g., connections to 12 volt power lines) are configured to reduce effects that the power lines might otherwise have on antenna performance (e.g., antenna pattern or impedance).

In one example automotive system, the brake light 110 uses a plurality (e.g. sixty) of high-intensity light emitting diodes (LEDs) powered by twelve volts of direct current. The direct current voltage is applied to the LED array through two parallel #18 AWG wires. These wires are molded into a common insulation package that electrically insulates them from one another and their surroundings. The brake light power leads are routed through the spoiler along a tapered path nearly parallel to the vertical portion of the low-band antenna 103. The average spacing along this taper is approximately 0.75". In this case, the power lead contributes to the ease of impedance matching with minimal effects upon the monopole radiation pattern by acting as parasitic elements.

Figure 2:
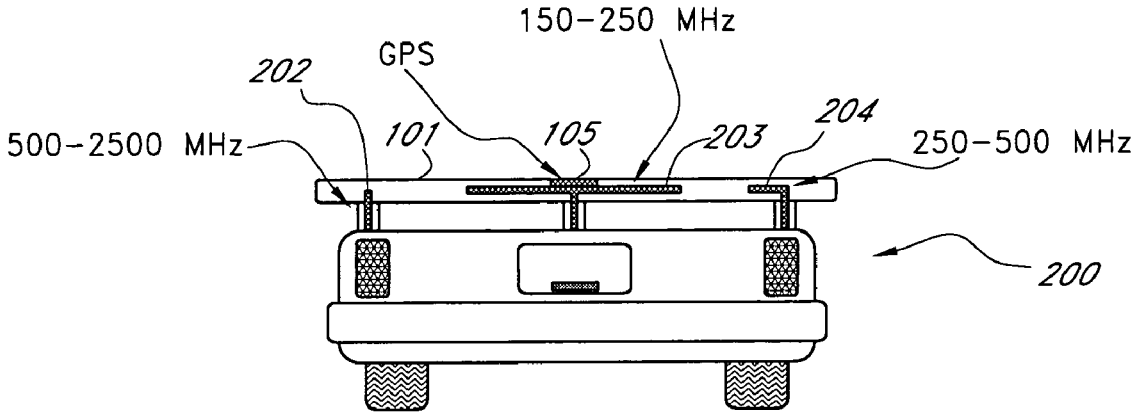
FIG. 2 shows a suite of antennas integrated into an automobile spoiler-type structure to provide relatively wide bandwidth coverage.

Greater bandwidths than those listed above can be achieved by various techniques. One technique is to integrate antennas that employ low-profile antenna concepts such as those used in aircraft blade antennas. Additionally, external broadband tuning modules can be used. Broadband antennas can be used to reduce or eliminate the need for fine-tuning of an antenna. FIG. 2 shows a system 200 that is similar to the system 100 and includes the spoiler 101, the horizontal-type antenna 105 and, optionally, the brake light 110. In the system 200, a low-band antenna 203 operates in a frequency band of 150–250 MHz, a medium-band antenna operates in a frequency band of 250–500 MHz and a high-band antenna operates in a frequency band of 500–2500 MHz. Thus, the system 200 provides bandwidth coverage from 150 MHz to 2.5 GHz. In one embodiment, Radio Frequency (RF) chokes are used to reduce interactions between the antennas 202–203. The upper frequency shown in FIG. 2 (2500 MHz) is not a limitation and higher frequencies can be accommodated by using additional horizontal-type antennas similar to the horizontal-type antenna 105. In one embodiment, a top portion of the low-band antenna 203 acts as a ground plane for the horizontal-type antennas such as the horizontal-type antenna 105. In one embodiment, signal lines (e.g., coaxial cables) for the horizontal-type antennas such as the horizontal-type antenna 105 are routed through the vertical portion of the low-band antenna 203.

Figure 3:
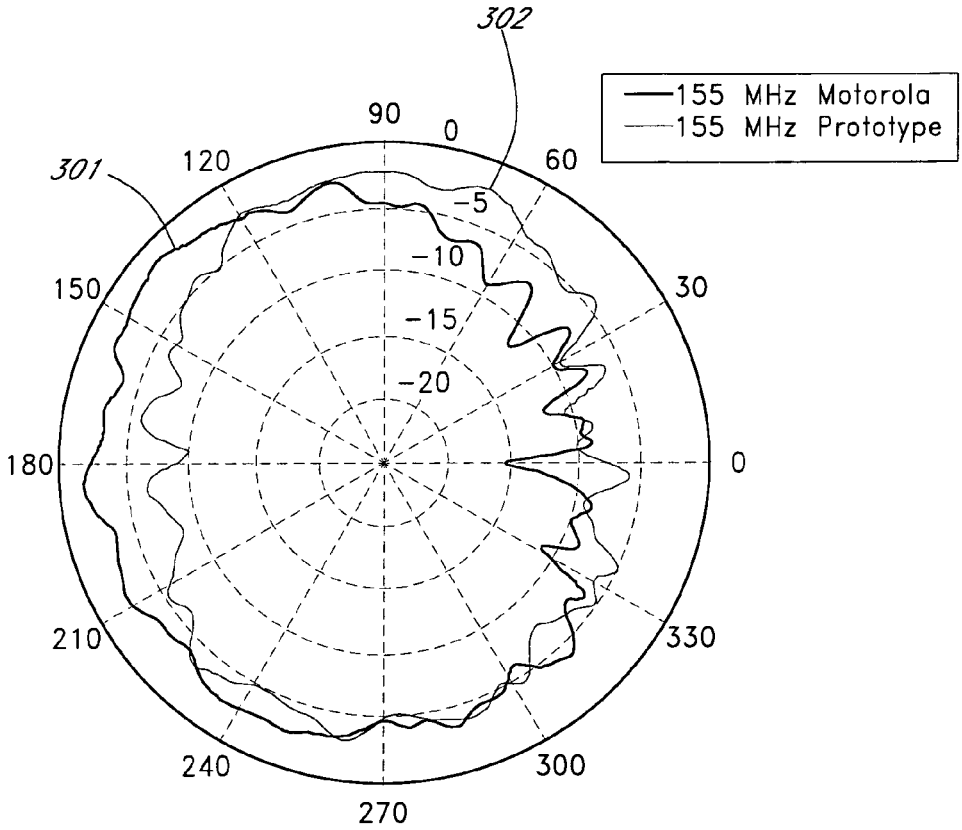
FIG. 3 shows power reception as a function of aspect angle at 155 MHz for a spoiler-mounted antenna and for a standard monopole whip antenna.
Figure 4:
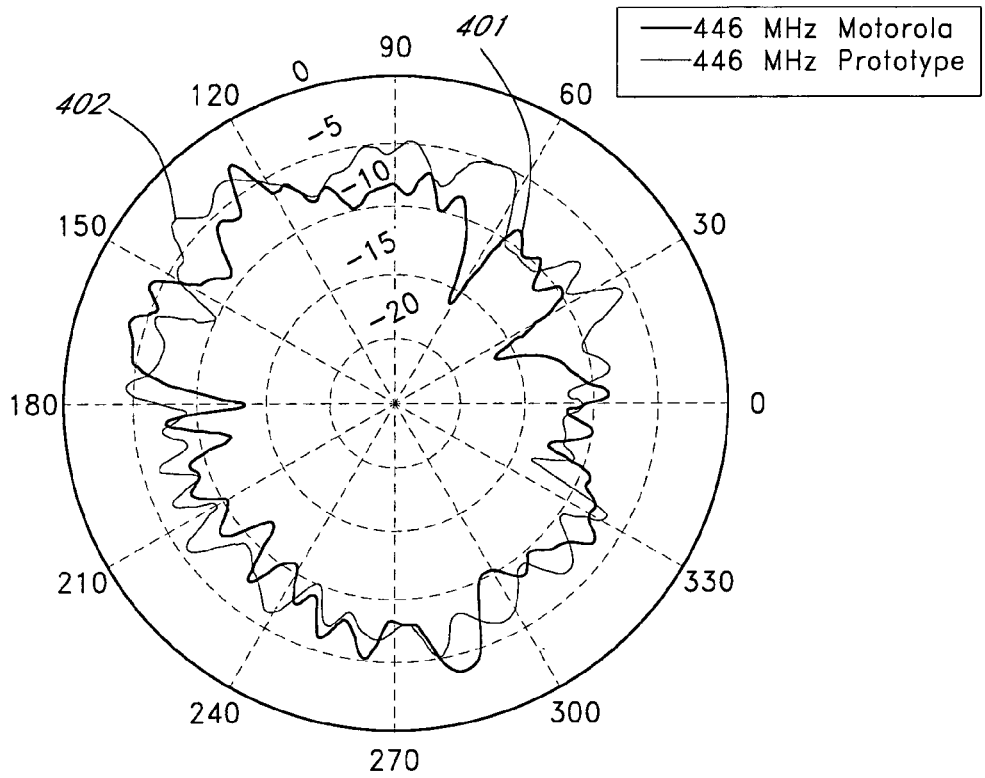
FIG. 4 shows power reception as a function of aspect angle at 446 MHz for a spoiler-mounted antenna and for a standard monopole whip antenna.
Figure 5:
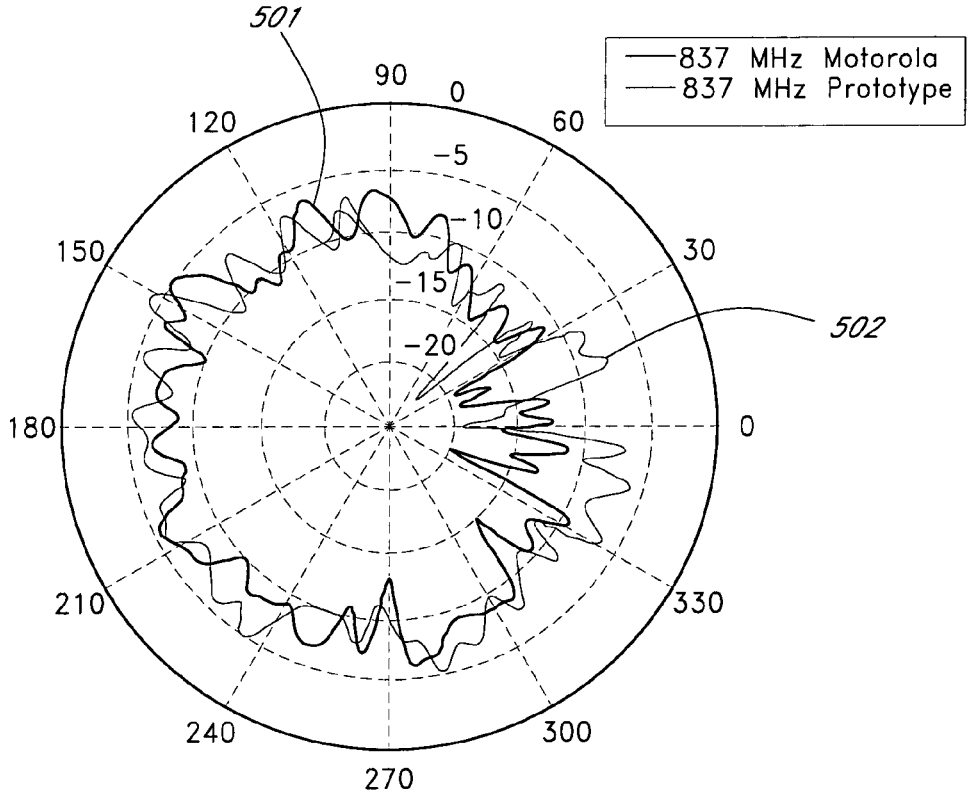
FIG. 5 shows power reception as a function of aspect angle at 837 MHz for a spoiler-mounted antenna and for a standard monopole whip antenna.

FIGS. 3–5 show pattern measurements on embodiments of the spoiler mounted antennas shown in FIGS. 1 and 2. Pattern measurements were performed for a spoiler (with integrated antennas) mounted on the vehicle. The spoiler antenna patterns were compared to conventional whip antenna patterns. In one embodiment, the conventional whip antennas used for comparison were mounted near the center of the trunk lid. FIG. 3 shows 155 MHz data. FIG. 4 shows 446 MHz data. FIG. 5 shows 837 MHz data. In FIGS. 3–5, the amplitude scale is relative dB, not dBi gain. In general, the spoiler antennas have better pattern coverage than the corresponding whip antenna, especially for aspects where the whip patterns are marginal.

Qualitative test results were obtained by mounting the spoiler, with antennas, on a vehicle and using at least one of the antennas to transmit and receive voice data as the vehicle was driven. The quality of the transmission and reception compared favorably to that obtained with a conventional surface mounted whip antenna.

Figure 6:
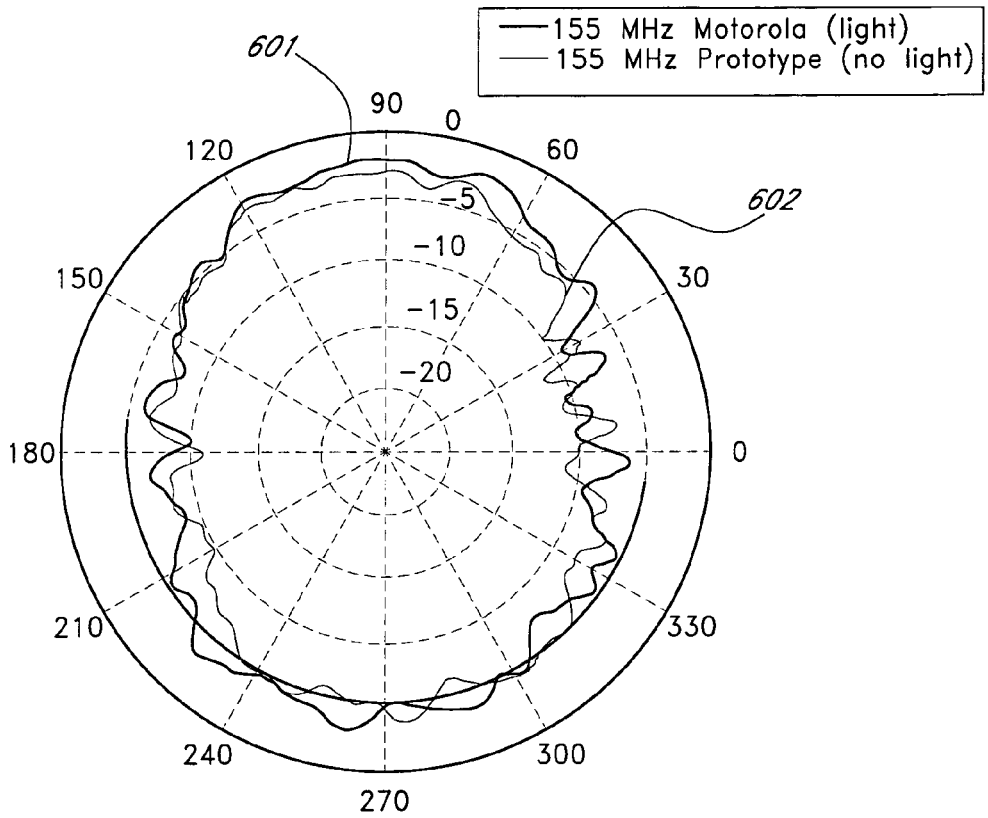
FIG. 6 shows power reception as a function of aspect angle at 155 MHz for a spoiler-mounted antenna with and without a third brake light in the spoiler.

The data in FIG. 6 shows the measured effect of the third brake light power leads on the pattern of the low-band antenna 103 with and without power leads. The power leads has relatively little effect on the antenna pattern.

Figure 7:
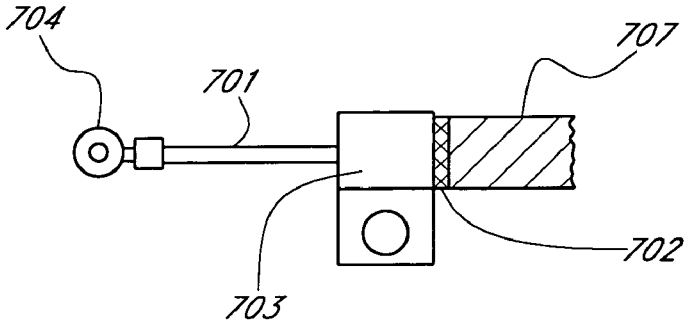
FIG. 7 shows a coax connection for the integrated antenna.

FIG. 7 shows one embodiment of an antenna connection to a coaxial cable. The coaxial cable, located inside the trunk, has a center conductor 701 and a shield 702. In one embodiment, a metal tab 703 is provided to the shield and a metal tab 704 is provided to the center conductor. The metal tab 703 provided to the shield can be attached to a suitable ground plane, such as, for example, a trunk lid. The metal tab 704 provided to the center conductor can be attached to a monopole-type antenna, such as, for example the antennas 102–104 or 202–204. An alternate technique, usually desirable for higher frequencies, is to connect the antenna lead and ground to a conventional bulkhead connector. The configuration shown in FIG. 7 has the advantage of being relatively low-cost and relatively low-profile.

Figure 8:
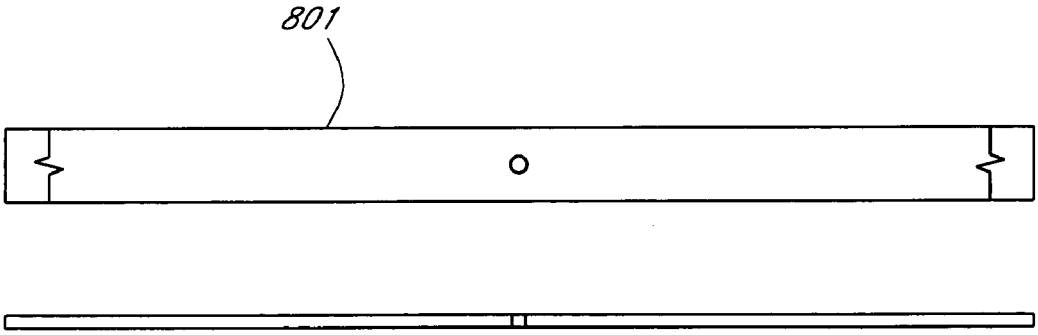
FIG. 8 shows one embodiment of a top-loaded antenna for integration in a spoiler.

FIG. 8 shows one embodiment of a top load 801 for a monopole such as the low-band antennas 103 and 203. Top loading increases the effective length of the monopole and therefore allows the monopole to operate a lower frequency with a relatively smaller vertical height than an unloaded monopole. In FIG. 8, the top load is constructed from a relatively thin sheet of conducting material and is suitable for use as a ground plane for other antennas. The top load 801 is attached at or near the top of a monopole antenna, as shown, for example, in FIGS. 1 and 2.

Figure 9:
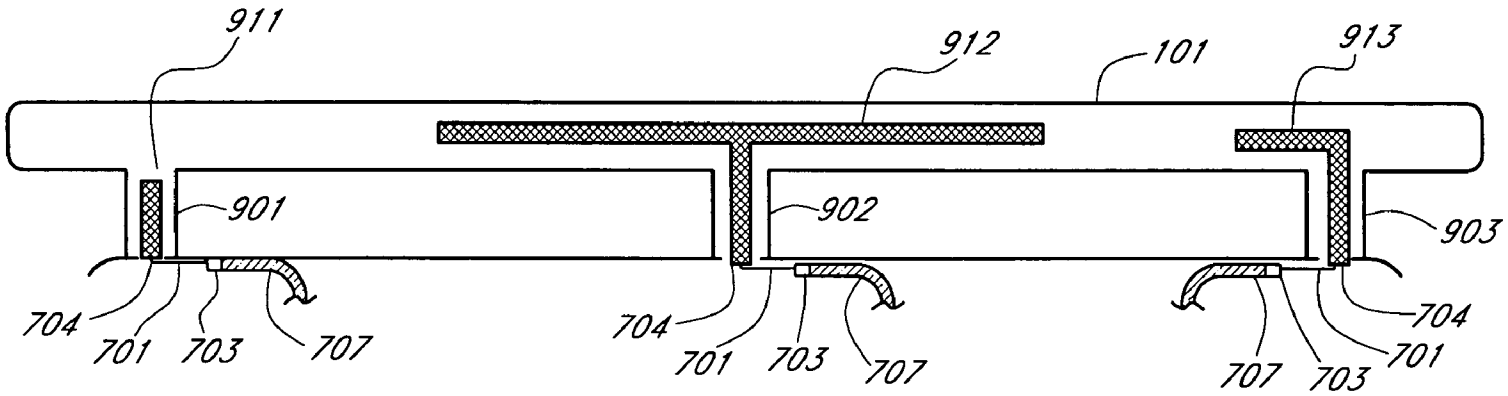
FIG. 9 shows integration of monopoles and top-loaded monopoles into an automobile spoiler.

FIG. 9 shows three antenna locations for monopole-type antennas in the spoiler 101. A first monopole 911 is placed inside a left-hand riser 901 of the spoiler 101. A base of the first monopole 911 antenna is provided at or electrically near the rear deck surface to which the spoiler is attached (e.g., to the trunk of the vehicle). The monopole 911 is provided to the center conductor of the coaxial cable according to the configuration shown in FIG. 7. The monopole 911 extends at least partially up into the left-hand riser 901. In one embodiment, the monopole 911 is straddled by one or more parasitic rods, each 3.6" long in order to increase bandwidth.

A second monopole 912 is placed inside a center riser 902. A base of the second monopole 912 is provided at or electrically near the rear deck surface to which the spoiler is attached. The second monopole 912 extends up into the center riser of the spoiler and attaches to a top load as shown in FIG. 8. The top load 801 is provided in the horizontal portion of the spoiler 101. The monopole 912 is provided to the center conductor of a the coaxial cable according to the configuration shown in FIG. 7.

In one embodiment, the length of the top load 801 is selected to provide desired operation in a band having a center frequency of approximately 155 MHz. In one embodiment, the length of the vertical portion of the second monopole 912 is 6 inches. In one embodiment, the length of the top load 801 is 18½ inches and its width is 4 inches.

A third monopole 913 is placed inside a right-hand riser 903 of the spoiler 101. A base of the third monopole 913 antenna is provided at or electrically near the rear deck surface to which the spoiler 101 is attached (e.g., to the trunk of the vehicle). The third monopole 913 is provided to the center conductor of a the coaxial cable according to the configuration shown in FIG. 7. The third monopole 913 extends at into the right-hand riser 903. A portion of the third monopole 913 extends up into a horizontal portion of the spoiler 101 and continues along inside the horizontal portion for a desired distance to top-load the third monopole 913. The monopole 913 is provided to the center conductor of a the coaxial cable according to the configuration shown in FIG. 7.

In one embodiment, the total length (vertical plus horizontal sections) of the third monopole 913 is adjusted to provide desired operation in a band having a center frequency. In one embodiment, the desired center frequency of the third monopole 913 is approximately 446 MHz. In one embodiment, the total length of the third monopole 913 is 7 inches. In another embodiment, the third monopole 913 is straddled by one or more parasitic rods to increase bandwidth. In one embodiment, two parasitic rods each 3.6" long are used.

Figure 10:
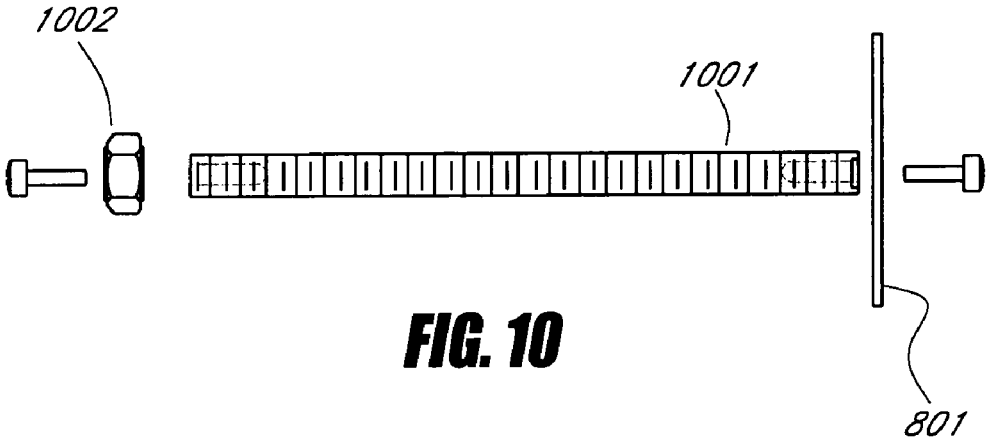
FIG. 10 shows construction of a monopole antenna for integration into an automobile spoiler.

FIG. 10 shows one embodiment of a top-loaded monopole having a threaded 5/16" antenna rod. The top load is attached to one end of the antenna rod. A molded dielectric insulator (e.g., nylon) is provided to the feed end of the monopole.

In one embodiment, the top load portion of the second monopole 912 (and/or the top load of the third monopole 913) is used as a ground plane supporting a horizontal-type antenna such as a patch-type, cavity-type, or slot-type antenna (e.g., a GPS antenna, an XM radio antenna, a wireless Internet antenna, a bluetooth antenna, etc.) The top load 801 serves as the ground plane for a common horizontal-type antenna, such as, for example, a patch-type antenna, a slot-type antenna, a cavity-backed antenna, a cavity-type antenna, a rectangular patch antenna, an elliptical patch antenna, a stacked patch antenna, a spiral antenna, helix antenna, an inverted "F" antenna, a microstrip patch antenna, a stripline antenna, a slot antenna, an annular slot antenna, etc.)

Figure 11:
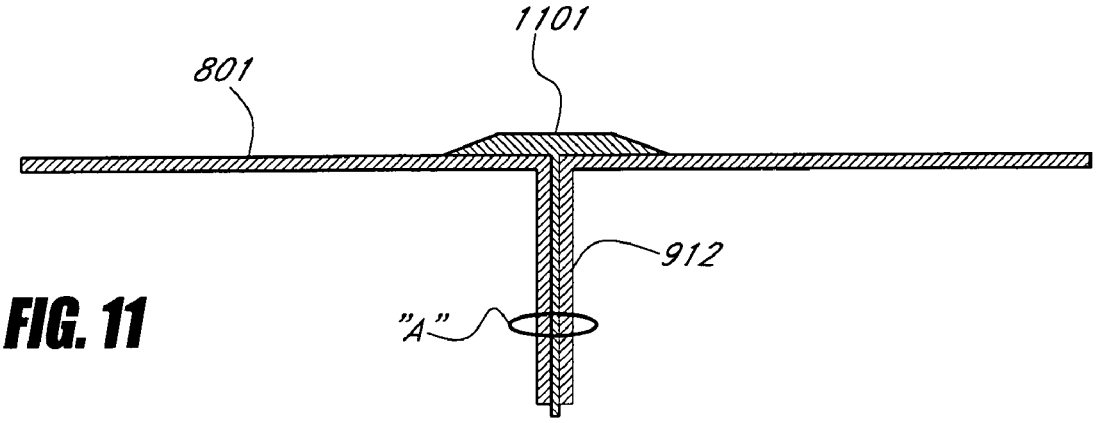
FIG. 11 shows integration of a patch-type antenna, including a coaxial signal path, into an automobile spoiler.
Figure 13:
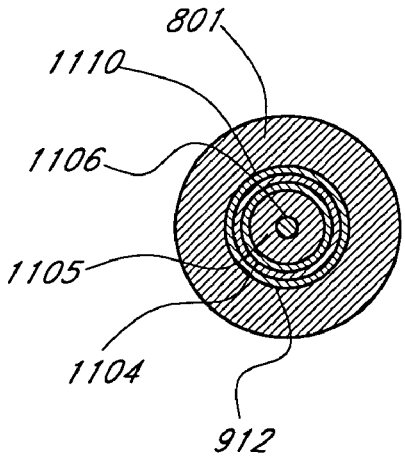
FIG. 13 shows integration of a coaxial signal path for the antennas of FIG. 11 or 12 into a monopole antenna.

As shown in FIG. 11 a coaxial cable for a patch-type antenna 1101 can be provided from the trunk interior to the antenna 1101 by passing through the monopole 912 (a cross-section "A" of the monopole portion 912 is shown in more detail in FIG. 13).

Figure 12:
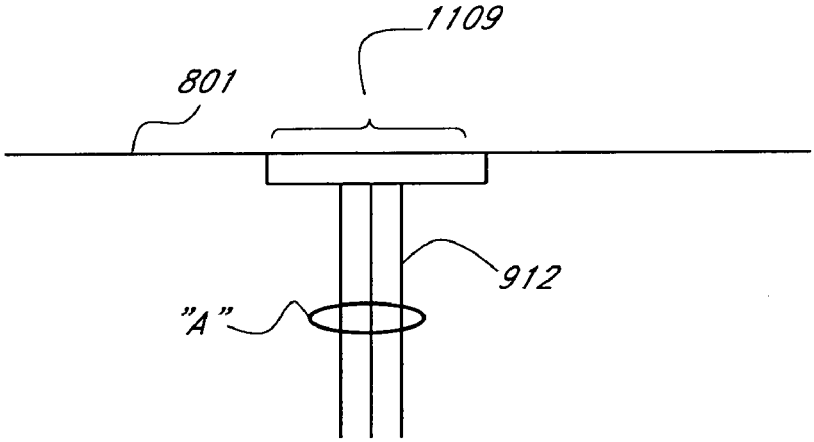
FIG. 12 shows integration of a cavity-type antenna, including a coaxial signal path, into an automobile spoiler.

As shown in FIG. 12 a coaxial cable for a slot-type or cavity-type antenna 1109 can similarly be provided from the trunk interior to the antenna 1101 by passing through the monopole 912 (a cross section "A" of the monopole portion 912 is shown in more detail in FIG. 13).

The technique shown in FIGS. 11 and 12 (using the top loading plate as a ground plane, and the vertical portion as a "conduit for the RF signal) is readily applied to other small antennas to extend frequency coverage to and beyond X-Band.

FIG. 13 shows a cross section of the monopole portion of the monopole 912 shown in FIGS. 11 and 12. In FIG. 13, the monopole 912 is shown as an outer conductor. Concentric layers inward from the monopole 912 include, an insulating ring 1110, an outer coaxial conductor 1104, a coaxial dielectric core 1105, and a coaxial inner conductor 1106. The coaxial conductor 1104, the coaxial dielectric core 1105, and the coaxial inner conductor 1106 form a coaxial feed for the antenna 1101 or 1109.

The horizontal-type antenna (e.g. the antenna 1101 and/or the antenna 1109) is shown provided in connection with the monopole antenna 912. One of ordinary skill in the art will recognize that a horizontal-type antenna (e.g. the antenna 1101 and/or the antenna 1109) can also be provided in connection with the top-loaded monopole antenna 913 in similar fashion. Thus, one, two, or more horizontal-type antennas can be provided in the spoiler 101. Moreover, several coaxial feeds can be provided in parallel in the monopole antenna 912 or 913 to feed several horizontal-type antennas disposed at various locations on the top-load 801. The outer conductor of the coaxial feed for the horizontal-type antennas can be disposed along the top-load 801 and, optionally, electrically connected to the top-load 801.

Although the foregoing has been a description and illustration of specific embodiments, various modifications and changes can be made thereto by persons skilled in the art. For example, one of ordinary skill will recognize that the spoiler antennas are not limited to the above frequency bands, and that antennas covering other frequency bands, broader bands, or combinations of bands can be provided as well. For convenience, the above disclosure describes embodiments in connection with an automobile spoiler-type structure 101. One of ordinary skill in the art will recognize that boats, aircraft, and other vehicles have similar spoiler-type structures, and such structures can be used as the spoiler 101. Therefore, the invention is limited only as defined by the following claims.

What is claimed is:

1. An integrated antenna system in an automobile rear-deck spoiler, comprising:

a first monopole antenna integrated into an automobile rear-deck spoiler, said first monopole having a substantially vertical portion and a top-load, said substantially vertical portion provided in a first riser;

a second antenna using said top-load as a around plane, wherein a coaxial cable for said patch-type antenna is provided inside said substantially vertical portion of said first monopole; and a brake light power lead routed through said spoiler along a path approximately parallel to said substantially vertical portion of said first monopole antenna.

2. An integrated antenna system in an automobile rear-deck spoiler, comprising:

a first monopole antenna integrated into an automobile rear-deck spoiler, said first monopole having a substantially vertical portion and a top-load, said substantially vertical portion provided in a first riser;

a second antenna using said top-load as a ground plane, wherein a coaxial cable for said patch-type antenna is provided inside said substantially vertical portion of said first monopole; and a brake light power lead configured to improve an impedance match of said first monopole antenna.

3. The apparatus of claim 2, further comprising at least one of, a video camera, an infrared sensor, an electro-optic sensor, and an air sensor.

4. The apparatus of claim 2, further comprising a third monopole antenna provided in a second riser.

5. The apparatus of claim 2, wherein said second antenna comprises a GPS antenna.

6. The apparatus of claim 2, wherein said second antenna comprises a patch-type antenna.

7. The apparatus of claim 2, wherein said second antenna comprises a cavity-type antenna.

8. An apparatus, comprising:

an automobile rear-deck spoiler having at least a first riser and a second riser;

a first monopole antenna disposed in said first riser, said first monopole antenna configured to operate in a first frequency band;

a second monopole antenna disposed in said second riser, said second monopole antenna configured to operate in a second frequency band; said second monopole antenna having a top load;

a first horizontal antenna configured to use said top load as a ground plane; and a brake light power lead routed through said first riser along a path approximately parallel to said first monopole antenna.

9. The apparatus of claim 8, wherein a coaxial feed for said first horizontal antenna is provided inside at least a portion of said second monopole antenna.

10. The apparatus of claim 8, further comprising a third monopole antenna provided in a third riser.

11. The apparatus of claim 8, wherein said first horizontal antenna comprises a GPS antenna.

12. The apparatus of claim 8, wherein said first horizontal antenna comprises a patch-type antenna.

13. The apparatus of claim 8, wherein said first horizontal antenna comprises a cavity-type antenna.

14. An apparatus, comprising:

an automobile rear-deck spoiler having at least a first riser and a second riser;

a first monopole antenna disposed in said first riser, said first monopole antenna configured to operate in a first frequency band;

a second monopole antenna disposed in said second riser, said second monopole antenna configured to operate in a second frequency band; said second monopole antenna having a top load;

a first horizontal antenna configured to use said top load as a ground plane; and a brake light power lead routed through said second riser along a path approximately parallel to said second monopole antenna.

15. An apparatus, comprising:

a vehicle having a spoiler-type structure comprising at least a first riser;

a first monopole antenna disposed in said first riser, said first monopole antenna having a top load, said first monopole antenna configured to operate in a first frequency band;

a first horizontal antenna configured to use said top load as a ground plane; and a brake light power lead routed through said first riser along a path approximately parallel to said first monopole antenna so as to improve an input impedance of said first monopole antenna.

16. The apparatus of claim 15, wherein a coaxial feed for said first horizontal antenna is provided inside at least a portion of said first monopole antenna.

17. The apparatus of claim 15, further comprising a second monopole antenna provided in a second riser, said second monopole antenna configured to operate in a second frequency band.

18. The apparatus of claim 15, wherein said first horizontal antenna comprises a GPS antenna.

19. The apparatus of claim 15, wherein said first horizontal antenna comprises a patch-type antenna.

20. The apparatus of claim 15, wherein said first horizontal antenna comprises a cavity-type antenna.

21. The apparatus of claim 15, wherein a coaxial feed for said first horizontal antenna is provided inside at least a portion of said first monopole antenna.

* * * * *

UNITED STATES PATENT AND TRADEMARK OFFICE

CERTIFICATE OF CORRECTION

PATENT NO. : 6,927,736 B1
DATED : August 9, 2005
INVENTOR(S) : Kornbau et al.

It is certified that error appears in the above-identified patent and that said Letters Patent is hereby corrected as shown below:

Title page,
Item [56], References Cited, U.S. PATENT DOCUMENTS, after "Izawa et al."
Insert -- 343/713 --.

Column 4,
Line 66, after "of" delete "a".

Column 5,
Lines 12 and 18, after "of" delete "a".
Line 48, change "etc.)" to -- etc. --.

Column 6,
Line 42, change "around" to -- ground --.

Signed and Sealed this

Second Day of May, 2006

JON W. DUDAS
*Director of the United States Patent and Trademark Office*